US007539431B2

(12) United States Patent
Watanabe et al.

(10) Patent No.: US 7,539,431 B2
(45) Date of Patent: May 26, 2009

(54) IMAGE FORMING APPARATUS AND TECHNIQUES FOR COLLECTING TONER

(75) Inventors: Takeshi Watanabe, Yokohama (JP); Masashi Takahashi, Yokohama (JP); Mitsuaki Kouyama, Higashi-kurume (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 46 days.

(21) Appl. No.: 11/477,219

(22) Filed: Jun. 29, 2006

(65) Prior Publication Data

US 2008/0002997 A1 Jan. 3, 2008

(51) Int. Cl.
*G03G 15/00* (2006.01)
*G03G 21/12* (2006.01)
*G03G 21/00* (2006.01)

(52) U.S. Cl. ..... 399/71; 399/35; 399/354

(58) Field of Classification Search ..... 399/35, 399/44, 71, 99, 150, 354
See application file for complete search history.

(56) References Cited

U.S. PATENT DOCUMENTS 4,999,679 A * 3/1991 Corbin et al. ..... 399/354
5,233,398 A * 8/1993 Nimura et al. ..... 399/354
6,381,425 B2 * 4/2002 Sasai ..... 399/44 X
7,130,564 B2 * 10/2006 Murakami et al. ..... 399/354 X

FOREIGN PATENT DOCUMENTS

| | | |
|---|---|---|
| JP | 09-251264 | 9/1997 |
| JP | 2000-242152 | 9/2000 |
| JP | 2001-083757 | 3/2001 |

* cited by examiner

*Primary Examiner*—Sandra L Brase
(74) *Attorney, Agent, or Firm*—Amin, Turocy & Calvin, LLP

(57) ABSTRACT

In an image forming apparatus that forms a toner image on a sheet of paper, a technique for achieving adequate toner collection from the photoconductive surface of the photoconductor to suit the situation is provided. An image forming apparatus performs image forming processing using plural image forming stations aligned along a specific direction and each transferring a toner image of a different color onto a transferred body moving in the specific direction, and includes: a toner collection unit provided to at least one image forming station among the plural image forming stations at any of second and subsequent places from an upstream side in the specific direction and configured to collect toner adhering onto a photoconductor in the at least one image forming station near a toner image transfer position of the photoconductor on a downstream side.

18 Claims, 15 Drawing Sheets

| TRANSFER BIAS | TRANSFER RESIDUAL TONER | INVERSELY TRANSFERRED TONER |
|---|---|---|
| 550v | −6.0μC/g | +2.5μC/g |
| 600v | −5.2μC/g | +4.0μC/g |
| 650v | −3.0μC/g | +7.0μC/g |

FIG.16

| | | | PATTERN | | COLOR DIFFERENCE IN CYAN STATION (DIFFERENCE FROM INITIAL QUANTITY, Δ E) | QUANTITY OF TONER STORED IN WASTE TONER STORING PORTION IN CYAN STATION (g) | IRREGULARITY IN MEMORY CHART AND MEMORY |
|---|---|---|---|---|---|---|---|
| | RELATED ART (ALMOST THE SAME STATE AS (3)) | NORMAL PAPER (80 g/sheet) | Ⓐ Y10%、M10% | 5k SHEETS | 15 | NONE | — |
| | | | Ⓑ Y10%、M10%、C10%、K10% | ABOVE + 5k SHEETS | 7 | NONE | — |
| | | | Ⓒ Y2%、M2%、C12%、K12% | ABOVE + 5k SHEETS | 3 | NONE | — |
| | | | Ⓓ MEMORY CHART (0.25k SHEETS FOR EACH COLOR) | ABOVE + 0.8k SHEETS | 3 | NONE | △MEMORY APPEARED SLIGHTLY |
| | | THICK PAPER (250 g/sheet) | | ABOVE + 0.2k SHEETS | 3 | NONE | ×MEMORY APPEARED |
| | (1) INVERSELY TRANSFERRED TONER COLLECTION MODE | NORMAL PAPER (80 g/sheet) | Ⓐ Y10%、M10% | 5k SHEETS | 4 | 6.2 | — |
| | | | Ⓑ Y10%、M10%、C10%、K10% | ABOVE + 5k SHEETS | 1 | 12 | — |
| | | | Ⓒ Y2%、M2%、C12%、K12% | ABOVE + 5k SHEETS | 0 | 14.3 | — |
| | | | Ⓓ MEMORY CHART (0.25k SHEETS FOR EACH COLOR) | ABOVE + 0.8k SHEETS | 0 | 14.5 | △MEMORY APPEARED SLIGHTLY |
| | | THICK PAPER (250 g/sheet) | | ABOVE + 0.2k SHEETS | 0 | 14.6 | ×MEMORY APPEARED |
| | (2) TRANSFER RESIDUAL TONER COLLECTION MODE | NORMAL PAPER (80 g/sheet) | Ⓐ Y10%、M10% | 5k SHEETS | 13 | 0.6 | — |
| | | | Ⓑ Y10%、M10%、C10%、K10% | ABOVE + 5k SHEETS | 6 | 12 | — |
| | | | Ⓒ Y2%、M2%、C12%、K12% | ABOVE + 5k SHEETS | 2 | 25.2 | — |
| | | | Ⓓ MEMORY CHART (0.25k SHEETS FOR EACH COLOR) | ABOVE + 0.8k SHEETS | 2 | 26.2 | ○SATISFACTORY |
| | | THICK PAPER (250 g/sheet) | | ABOVE + 0.2k SHEETS | 2 | 27 | ○SATISFACTORY |
| | (3) STIRRING MODE | NORMAL PAPER (80 g/sheet) | Ⓐ Y10%、M10% | 5k SHEETS | 14.5 | 0 | |
| | | | Ⓑ Y10%、M10%、C10%、K10% | ABOVE + 5k SHEETS | 6.5 | 0.2 | |
| | | | Ⓒ Y2%、M2%、C12%、K12% | ABOVE + 5k SHEETS | 3 | 0.4 | |
| | | | Ⓓ MEMORY CHART (0.25k SHEETS FOR EACH COLOR) | ABOVE + 0.8k SHEETS | 3 | 0.4 | △MEMORY APPEARED SLIGHTLY |
| | | THICK PAPER (250 g/sheet) | | ABOVE + 0.2k SHEETS | 3 | 0.4 | ×MEMORY APPEARED |
| EXAMPLES WHEN PRESENT INVENTION IS APPLIED | ① | NORMAL PAPER (80 g/sheet) | Ⓐ Y10%、M10% | 5k SHEETS | 3.9 | 6 | |
| | ② | | Ⓑ Y10%、M10%、C10%、K10% | ABOVE + 5k SHEETS | 0.9 | 6.3 | |
| | ③ | | Ⓒ Y2%、M2%、C12%、K12% | ABOVE + 5k SHEETS | 0.2 | 6.6 | |
| | ① | | Ⓓ MEMORY CHART (0.25k SHEETS FOR EACH COLOR) | ABOVE + 0.8k SHEETS | 0.2 | 7.6 | ○SATISFACTORY |
| | ② | THICK PAPER (250 g/sheet) | | ABOVE + 0.2k SHEETS | 0.3 | 8.5 | ○SATISFACTORY |

IMAGE FORMING APPARATUS AND TECHNIQUES FOR COLLECTING TONER

BACKGROUND OF THE INVENTION

1. Field of the Invention

The present invention relates to an image forming apparatus that forms a toner image on a sheet of paper, and more particularly, to a technique for collecting toner from a photoconductive surface of a photoconductor.

2. Description of the Related Art

While toner has been becoming smaller in size and more spherical in shape as the image quality of an image forming apparatus is upgraded, application of the traditional blade cleaning has been becoming difficult. Such being the case, so-called cleanerless process that does not use a blade has been attracting attention.

According to the cleanerless process in a color image forming apparatus of the so-called tandem system, when an image transferred onto a sheet of paper or an intermediate transfer body in an image forming station on the upstream side reaches the non-image portion of the photoconductor in an image forming station at the latter stage, an event that part of the image adheres onto the photoconductor, known as "inverse transfer" phenomenon, may possibly take place. Toner transferred onto a sheet of paper in the image forming station on the upstream side is inversely transferred onto the photoconductor at the transfer position in the image forming station at the latter stage, and collected in a developer in the latter stage without being subjected to blade cleaning. This gives rise to so-called color mixing phenomenon that the color tone of toner in the developer in the image forming station at the latter stage changes gradually. Although the degree of change varies with the kinds or patterns of an image to be printed, it is still a fundamental problem of the cleanerless process in the color image forming apparatus of the tandem system.

Generally, the polarity of transfer residual toner of the normal color remaining on the photoconductor, which has been developed but has not been transferred in the transfer process in one image forming station, is the normal polarity of the toner, whereas the mixed color toner remaining on the photoconductor after the transferring, which has been transferred onto a sheet of paper in the image forming station on the upstream side and inversely transferred onto the photoconductor at the transfer position in the above-specified image forming station, is often charged to a reversed polarity to the normal polarity.

Given these circumstances, a technique for solving the color mixing problem of toner as described above has been disclosed (see JP-A-2000-242152).

The related art described above provides "inversely transferred toner removing means" for selectively collecting inversely transferred toner migrating from the image forming station in the preceding stage, which is chiefly produced in the tandem system. According to this related art, a roller-shaped member (for example, a brush roller) used to remove inversely transferred toner is pressed against the photoconductor after the transferring and bias of the same polarity as the normal charged polarity of toner is applied, so that toner charged to the reversed polarity alone is selectively collected. In this instance, toner of the normal color is not collected, and instead it is collected in the developer by way of the charger and the exposure device after it is stirred to erase the memory pattern. The so-called cleanerless process is thus achieved.

The related art, however, has problems chiefly as follows.

That is, in the related art, it is possible to collect inversely transferred toner (that is, mixed color toner); however, transfer residual toner of the normal color is not collected, and instead it is collected in the developer after passing by the charger and the exposure device. Because it is the toner of the normal color, no color mixing occurs. Nevertheless, when a quantity of the transfer residual toner is large, the pattern is not erased in a satisfactory manner by stirring the transfer residual toner in the inverse transfer cleaner portion. This gives rise to irregular charging or shielding of light during exposure, and image formation in the following process is adversely affected.

In addition, in the related art described above, although being the inversely transferred toner, waste toner is constantly generated from it, and there is a need for a place to store collected waste toner. Providing a waste toner box separately from the cleaner portion raises the need for carrying means for carrying waste toner from the cleaner portion to the waste toner box, which complicates the apparatus configuration. Because the inversely transferred toner is generally far less than the transfer residual toner in quantity, the inverse transfer cleaner portion and the waste toner storing portion may be formed as one body and provided in the form of a cartridge. The waste toner storing portion, however, becomes larger in size when the life of the inverse transfer cleaner is long, which may possibly pose an obstacle to achieve a size reduction of the apparatus.

SUMMARY OF THE INVENTION

The present invention has been devised to solve the problems discussed above, and therefore has an object to provide a technique for achieving appropriate toner collection from the photoconductive surface of the photoconductor to suit the situation in an image forming apparatus that forms a toner image on a sheet of paper.

In order to solve the problems discussed above, an image forming apparatus according to one aspect of the invention is an image forming apparatus that performs image forming processing using plural image forming stations aligned along a specific direction and each transferring a toner image of a different color onto a transferred body moving in the specific direction, including: a toner collection unit provided to at least one image forming station among the plural image forming stations at any of second and subsequent places from an upstream side in the specific direction and configured to collect toner adhering onto a photoconductor in the at least one image forming station near a toner image transfer position of the photoconductor on a downstream side, the toner collection unit being capable of switching between an inversely transferred toner collection mode to selectively collect inversely transferred toner having a charged polarity different from a polarity of toner used in the image forming station to which the toner collection unit is provided and a transfer residual toner collection mode to selectively collect transfer residual toner having a charged polarity same as the polarity of the toner used in the image forming station to which the toner collection unit is provided; a judgment unit configured to judge which of the transfer residual toner and the inversely transfer toner needs to be collected according to specific information; and a control unit configured to control the toner collection unit to execute the transfer residual toner collection mode when the judgment unit judges that the transfer residual toner needs to be collected, and to control the toner collection unit to execute the inversely transferred toner collection mode when the judgment unit judges that the inversely transferred toner needs to be collected.

An image forming apparatus according to another aspect of the invention is an image forming apparatus that performs image forming processing using plural image forming stations aligned along a specific direction and each transferring a toner image of a different color onto a transferred body moving in the specific direction, including: a toner collection unit provided to at least one image forming station among the plural image forming stations at any of second and subsequent places from an upstream side in the specific direction and configured to collect toner adhering onto a photoconductor in the at least one image forming station near a toner image transfer position of the photoconductor on a downstream side, the toner collection unit being capable of switching between an inversely transferred toner collection mode to selectively collect inversely transferred toner having a charged polarity different from a polarity of toner used in the image forming station to which the toner collection unit is provided and a stirring mode to stir toner on the photoconductor in the image forming station to which the toner collection unit is provided; a judgment unit configured to judge which of operations to collect the inversely transferred toner and to stir the toner on the photoconductor needs to be performed according to specific information; and a control unit configured to control the toner collection unit to execute the inversely transferred toner collection mode when the judgment unit judges that the inversely transferred toner needs to be collected, and to control the toner collection unit to execute the stirring mode when the judgment unit judges that the toner on the photoconductor needs to be stirred.

An image forming apparatus according to still another aspect of the invention is an image forming apparatus that performs image forming processing using an image forming station that transfers a toner image onto a transferred body moving in a specific direction, including: a toner collection unit provided to the image forming station and configured to collect toner adhering onto a photoconductor in the image forming station near a toner image transfer position of the photoconductor on a downstream side, the toner collection unit being capable of switching between a transfer residual toner collection mode to selectively collect transfer residual toner having a charged polarity same as a polarity of toner used in the image forming station to which the toner collection unit is provided and a stirring mode to stir toner on the photoconductor in the image forming station to which the toner collection unit is provided; a judgment unit configured to judge which of operations to collect the transfer residual toner and to stir the toner on the photoconductor needs to be performed according to specific information; and a control unit configured to control the toner collection unit to execute the transfer residual toner collection mode when the judgment unit judges that the transfer residual toner needs to be collected, and to control the toner collection unit to execute the stirring mode when the judgment unit judges that the toner on the photoconductor needs to be stirred.

DESCRIPTION OF THE DRAWINGS

FIG. 16 is a view showing the result, such as a color mixing level and a quantity of waste toner.

DESCRIPTION OF THE EMBODIMENTS

Hereinafter, embodiments of the present invention will be described with reference to the drawings.

In this embodiment, a color electrophotographic apparatus of the so-called tandem system will be described, and plural image forming units are disposed on transfer means, such as a belt, or a sheet of paper. Herein, a case where the reversal development method is adopted for negatively charged toner will be described. It should be appreciated, however, that toner is not necessarily charged negatively, and it may be charged positively. In short, the polarity of toner does not matter as long as the reversal development is adopted.

Figure 1:
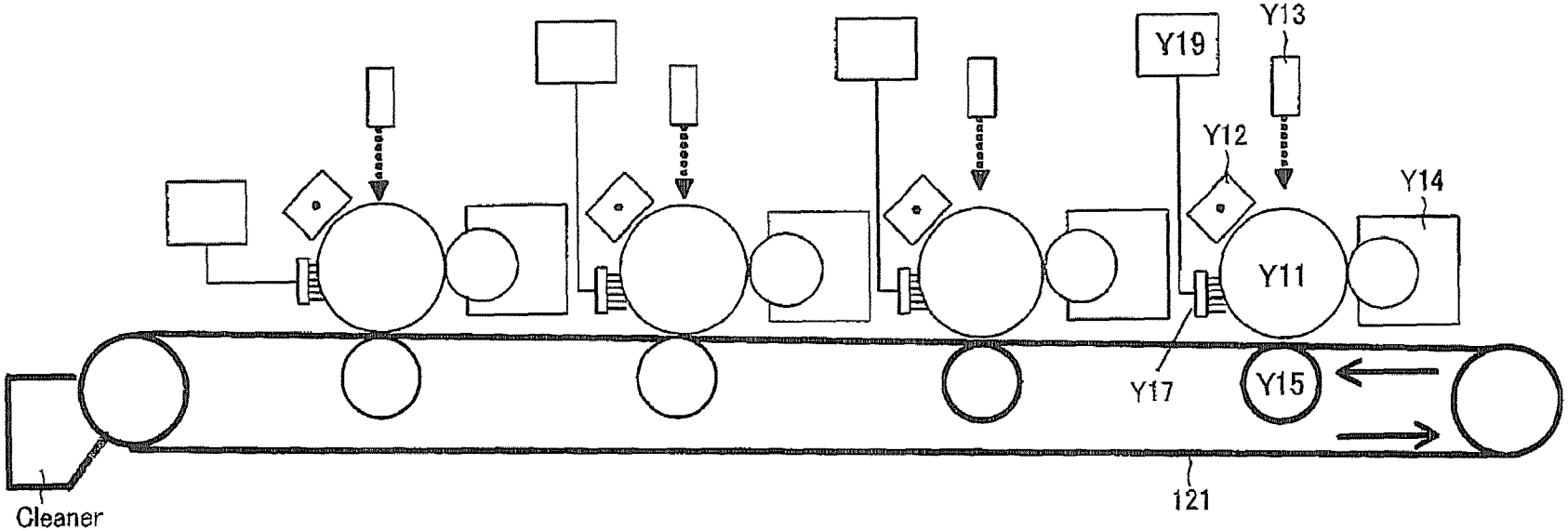
FIG.1 PRIOR ART
FIG. 1 is a view schematically showing the configuration of an image forming apparatus in the related art using a typical cleanerless process.

FIG. 1 shows a view schematically showing the configuration of an image forming apparatus in the related art using a typical cleanerless process. The image forming apparatus shown in FIG. 1 performs image forming processing using plural image forming stations aligned along a specific direction and each transferring a toner image of a different color onto a transferred body moving in the specific direction.

In the image forming apparatus in the related art shown in the drawing, an image carrier in an image forming portion at the first stage (herein, a yellow station) is a photoconductive drum Y11 comprising an organic or amorphous silicon photoconductive layer formed on a conductive base body. Assume that the photoconductive drum Y11 used herein is an organic photoconductor charged to the negative polarity. This image carrier is uniformly charged, for example, at −500 v, by a known corona charger (alternatively, a roller charger or a scorotron charger) Y12, and is then exposed to a laser beam, LED light, or the like modulated according to an image by exposure means Y13. An electrostatic latent image is thus formed on the surface thereof. In this instance, the potential on the exposed surface of the photoconductor is, for example, about −80 v. Subsequently, the electrostatic latent image is turned to a visible image by a developer Y14. The developer Y14 adopts a two-component development method using a mixture of non-magnetic toner and magnetic carrier charged to the negative polarity. It forms carrier spikes on the developing roller equipped with a magnet, and by applying about −200 v to −400 v to the developing roller, it allows toner to adhere to the exposed portion on the surface of the photoconductor while inhibits toner to adhere to the non-exposed portion.

The visible image on the photoconductor is further transferred onto a sheet of paper (transferred body) carried by a transfer belt (or a transfer roller) 121 serving also as a sheet carrying member. In this instance, an electric field is supplied by a transfer member, such as a transfer roller Y15 (alternatively, a transfer blade or a transfer brush) brought into contact with the back surface of the transfer belt 121. A voltage applied to the transfer member is about +300 to +2 kv. Residual toner or the like remaining on the photoconductor after the transferring passes by the transfer portion, after which the image pattern is stirred by a stirring member Y17, such as a brush, provided ahead the following charging means. The photoconductor is then further subjected to electricity removal processing as needed, and the charging process described above is repeated again. A specific bias voltage is applied to the stirring member Y17 from a bias application power supply Y19. In this instance, the transfer residual toner having passed by the corona charger Y12 has been charged to the same polarity (negative polarity in this embodiment) as the charged potential of the photoconductor by undergoing the charging process. When it reaches the developer Y14, new toner is layered on the transfer residual toner in the image portion of the photoconductor and developed by the developer Y14, whereas the transfer residual toner in the non-image portion is collected on the developing roller side. So-called cleaning simultaneous with developing is thus performed. It is thus possible to perform continuously the electrophotographic process in the image forming portion at the first stage even when the cleaning device, such as blade, is not provided onto the photoconductor.

Subsequently, regarding image forming portions at the second and following stages, the image forming portion (magenta station) at the second stage will be described by way of example. The image carrier, the charger, the exposure device, the developer, the transfer member, and so forth are of the same configurations as their counterparts at the first stage. It should be noted, however, that because the image formed in the image forming portion (yellow station) at the preceding stage and transferred onto the sheet of paper comes into the transfer portion at the second stage at the transfer position of the toner image, the transfer condition may vary slightly. Moreover, depending on the conditions, a phenomenon may occur that part of the image formed in the image forming portion at the first stage is inversely transferred onto the image carrier at the second stage. Image forming portions at the third stage and the fourth stage are provided sequentially, and they are of the same configuration as the counterpart at the second stage.

In this manner, an image comprising toners of plural colors transferred onto the sheet of paper subsequently passes by a fixing device and is turned into an output image.

Figures 2, 3:
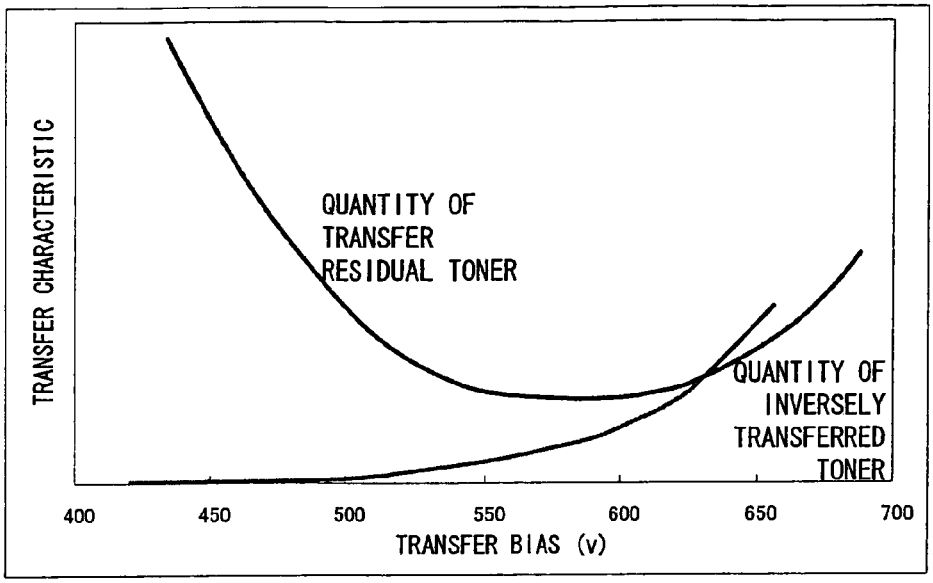
FIG. 2 is a graph showing the relation of transfer bias with respect to a quantity of transfer residual toner and a quantity of inversely transferred toner.
FIG. 3 is a table showing the relation of transfer bias with respect to average charged quantities for a quantity of transfer residual toner and a quantity of inversely transferred toner.

Although it depends on the transfer conditions, normally, the transfer residual toner is often charged to the negative polarity for the negatively charged toner, while the inversely transferred toner is charged to the reversed polarity, that is, the positive polarity. FIG. 2 is a graph showing the relation of the transfer bias with respect to a quantity of the transfer residual toner and a quantity of the inversely transferred toner. FIG. 3 is a table showing the relation of the transfer bias with respect to average charged quantities for a quantity of the transfer residual toner and a quantity of the inversely transferred toner.

Figure 4:
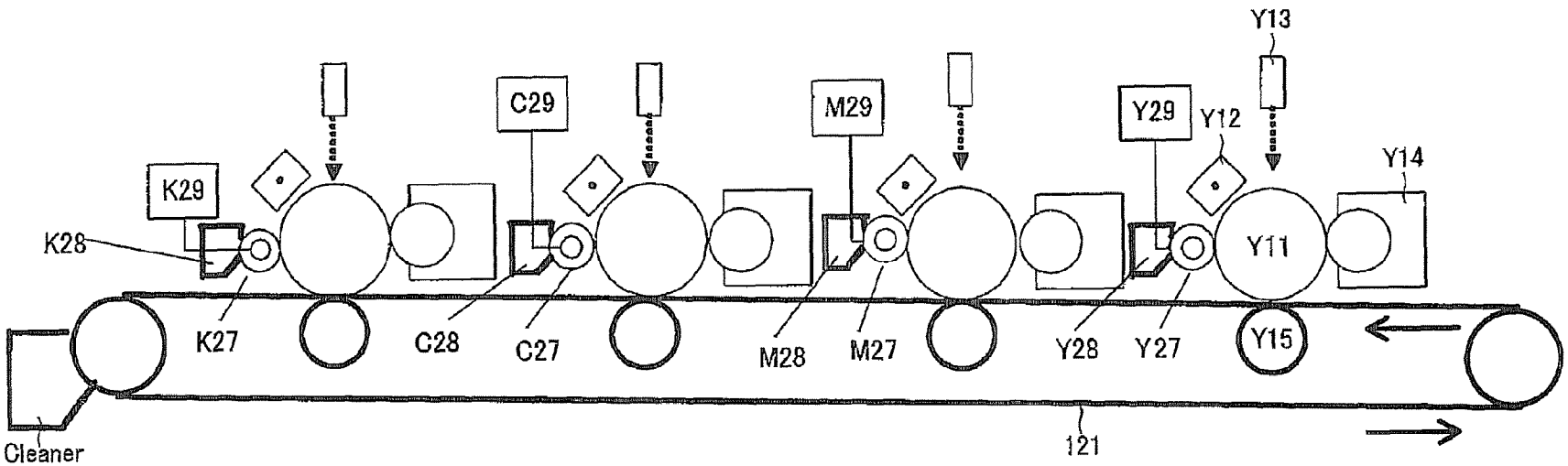
FIG.4 PRIOR ART
FIG. 4 is a view schematically showing the configuration of an image forming apparatus in the related art that collects inversely transferred toner alone.

FIG. 4 is a view schematically showing the configuration of an image forming apparatus in the related art that collects the inversely transferred toner alone. The image forming apparatus shown in the drawing is provided with inversely transferred toner cleaners (Y27 through K27 and Y29 through K29) as the mechanisms to selectively collect the inversely transferred toner at the positions of the stirring members in the configuration shown in FIG. 1. Negative bias is applied to the toner collecting members (herein, elastic rollers or the like) (Y27 through K27) provided to the inversely transferred toner cleaners from bias application power supplies (Y29 through K29), so that the inversely transferred toner charged to the reversed polarity (positive) is collected without collecting the normal transfer residual toner. As an example of the configuration, for example, by applying −600 v to a conductive elastic roller, it is possible to allow reversely charged, that is, positively charged toner alone to migrate onto the roller without collecting the negatively charged transfer residual toner. Meanwhile, the inversely transferred toner is scraped off by cleaning blades (Y28 through K28) that are brought into contact with the rollers.

In this case, because the inversely transferred toner is selectively collected, the affect of color mixing is reduced to the minimum. However, an obstacle during exposure is rather the transfer residual toner in a far excessive quantity, and the brush or roller to which the bias of the negative polarity is applied achieves only a small stirring effect for the transfer residual toner of the negative polarity. When a quantity of the transfer residual toner increases depending on the environments or use situations, because the stirring function is not sufficient, the previous history pattern (so-called memory pattern) may possibly appear on the image.

Figure 5:
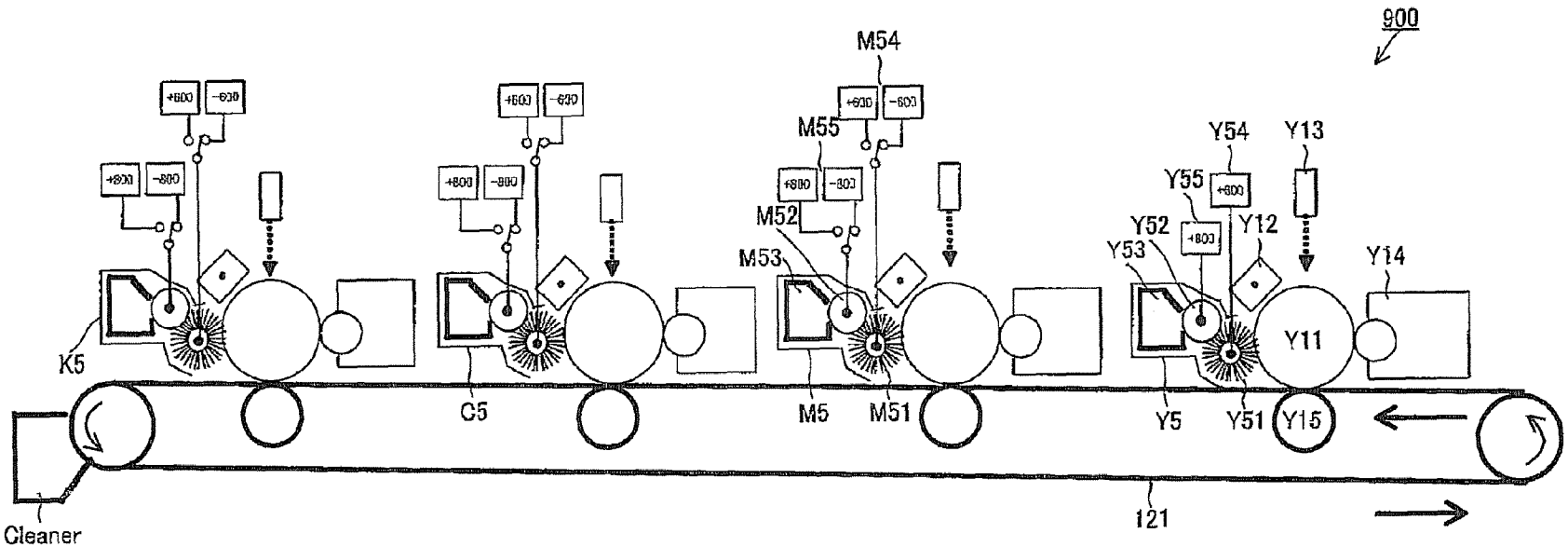
FIG. 5 is a view schematically showing the configuration used to describe an image forming apparatus according to one embodiment of the invention.

FIG. 5 is a view schematically showing the configuration of an image forming apparatus (for example, an MFP (Multi Function Peripheral) or the like) according to one embodiment of the present invention. The image forming apparatus of this embodiment and the image forming apparatus in the related art described above differ from each other in the configuration near the toner image transfer position on the downstream side in the moving direction of the photoconductive surface of the photoconductor (the configuration in the vicinity of means for collecting the inversely transferred toner). Hereinafter, components having the same functions as those of the counterparts in the image forming apparatus in the related art as described above are labeled with the same reference numerals, and descriptions of these components are omitted.

The image forming apparatus 900 of this embodiment is provided with toner collection portions Y5 through K5 instead of the stirring members shown in FIG. 1 and the inversely transferred toner cleaners shown in FIG. 4.

The toner collection portion Y5 includes a brush roller (toner collecting member) Y51 that collects toner adhering onto the photoconductive surface of the photoconductor Y11, a metal roller Y52 that collects toner adhering onto the brush roller Y51, a cleaning blade Y53 that removes toner adhering onto the surface of the metal roller Y52, a bias application power supply Y54 that applies a bias voltage (herein, +600 V) to the brush roller Y51, and a bias application power supply Y55 that applies a bias voltage (herein, +800 V) to the metal roller Y52.

The toner collection portion M5 includes a brush roller (toner collecting member) M51, a metal roller M52 that collects toner adhering onto the brush roller M51, a cleaning blade (toner removing member) M53 that removes toner adhering onto the surface of the metal roller M52, a bias application power supply M54 capable of applying two bias voltages (herein, +600 V or −600 V) to the brush roller M51, and a bias application power supply M55 capable of applying two bias voltages (herein, +800 V or −800 V) to the metal roller M52.

The toner collection portion C5 and the toner collection portion K5 are of the same configuration as the toner collection portion M5.

Figure 6:
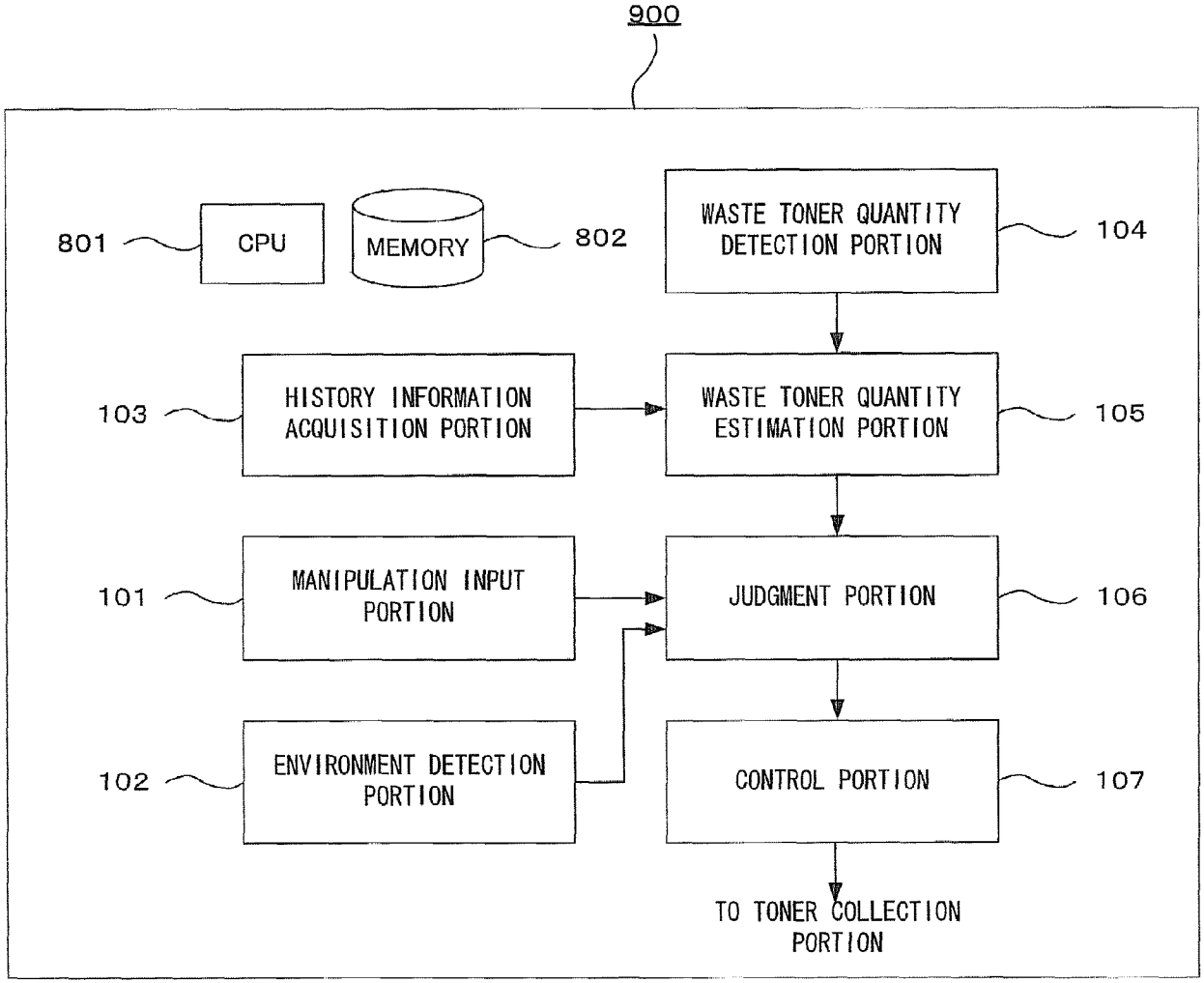
FIG. 6 is a functional block diagram used to describe an image forming apparatus 900 according to one embodiment of the invention.

FIG. 6 is a functional block diagram used to describe the image forming apparatus 900 according to one embodiment of the present invention. The image forming apparatus 900 of this embodiment includes a manipulation input portion 101, an environment detection portion 102, a history information acquisition portion 103, a waste toner quantity detection portion 104, a waste toner quantity estimation portion 105, a judgment portion 106, a control portion 107, toner collection portions Y5 through K5, a CPU 801, and a memory 802.

The manipulation input portion 101 comprises a keyboard, a mouse, etc., and plays a role of accepting a manipulation input from the user.

The environment detection portion 102 comprises a temperature sensor and a humidity sensor, and detects, either directly or indirectly (estimates from informed temperature or the like), the temperature and the humidity in the vicinity of the photoconductor in each image forming station of the image forming apparatus 900.

The history information acquisition portion 103 acquires information about the history of image formation processing in the image forming apparatus 900 from the memory 802 or an outside device connected to the image forming apparatus 900 to enable communications.

The waste toner quantity detection portion 104 detects quantities of toner accumulated in toner storing portions inside the housings of the toner collection portions M5 through K5 using, for example, an optical sensor or the like.

Among the plural image forming stations, the toner collection portions M5 through K5 are provided to at least one image forming station at any of the second and subsequent places from the upstream side in a specific direction, and play a role of collecting toner adhering onto the photoconductor in the at least one image forming station near the toner image transfer position of the photoconductor on the downstream side. In addition, the toner collection portions M5 through K5 are able to switch among an "inversely transferred toner collection mode" to selectively collect the inversely transferred toner having a charged polarity different from that of the toner used in the image forming station to which the toner collection portion is provided, a "transfer residual toner collection mode" to selectively collect the transfer residual toner having the same charged polarity as that of the toner used in the image forming station to which the toner collection portion is provided, and a "stirring mode" to stir toner on the photoconductor in the image forming station to which the toner collection portion is provided.

The waste toner quantity estimation portion 105 estimates quantities of toner accumulated in the toner collection portions M5 through K5 on the basis of the quantities of toner detected in the waste toner quantity detection portion 104 or the information acquired in the history information acquisition portion 103.

In a case where image data of an image to be formed on a sheet of paper shows that a print ratio in an image forming station disposed upstream in the specific direction from an image forming station provided with an arbitrary toner collection portion exceeds a specific print ratio, the judgment portion 106 judges that the inversely transferred toner needs to be collected in the arbitrary toner collection portion.

The judgment portion 106 judges that the transfer residual toner needs to be collected in the toner collection portions M5 through K5 in a case where a manipulation input to select the high quality mode is accepted at the manipulation input portion 101, in a case where the temperature and the humidity detected by the environment detection portion fit to a specific high temperature and high humidity condition, or in a case where image data of an image to be formed on a sheet of paper shows that a print ratio exceeds a specific print ratio in the image forming station.

Also, the judgment portion 106 judges that the toner on the photoconductor needs to be stirred in a case where a quantity of toner estimated by the waste toner quantity estimation portion 105 exceeds a specific quantity.

In this manner, the judgment portion 106 judges which of the operations to collect the transfer residual toner, to collect the inversely transferred toner, and to stir toner on the photoconductor needs to be performed on the basis of specific information (settings by the user, a quantity of inversely transferred toner of a different color, a quantity of toner of a different color accumulated in the developer, a quantity of waste toner accumulated in the waste toner storing portion, etc.)

In a case where the judgment portion 106 judges that the transfer residual toner needs to be collected, the control portion 107 controls the toner collection portion to execute the transfer residual toner collection mode. In a case where the judgment portion 106 judges that the inversely transferred toner needs to be collected, it controls the toner collection portion to execute the inversely transferred toner collection mode. In a case where the judgment portion 106 judges that toner on the photoconductor needs to be stirred, it controls the toner collection portion to execute the stirring mode.

To be more concrete, the control portion 107 controls the toner collection portion to switch between "inversely transferred toner collection mode" and "transfer residual toner collection mode" by switching the polarities of a bias voltage applied to the brush roller.

The CPU 801 plays a role of performing various kinds of processing in the image forming apparatus 900, and also plays a role of achieving various functions by executing programs stored in the memory 802. The memory 802 comprises, for example, a ROM, a RAM, or the like, and plays a role of storing various kinds of information and programs used in the image forming apparatus 900.

The brush roller forming the toner collection portion is made of, for example, nylon or rayon, and has the resistance of 10e4 to 10e10Ω, the thickness of 0.5 to 8 deniers, and the roller diameter of 10 to 20 mm. It is configured to be driven to rotate by providing a difference in velocity with respect to the photoconductor. In an experiment, the one made of nylon and having the thickness of 2 deniers, the diameter of 16 mm, and the resistance of 1×10e7Ω was used, and −600 v was applied while being rotated at a velocity twice as high as that of the photoconductor in the with direction (a rotational direction that moves in the same direction at the position at which the brush roller and the photoconductor come in contact with each other).

Also, a metal roller having ϕ14 serving as cleaning means is pressed against the brush roller, and it is rotated in the with direction at half the velocity of the brush while −800 v is kept applied. Further, a cleaning blade is pressed against the metal roller for the inversely transferred toner to be removed from the metal roller and accumulated in the waste toner storing portion. The metal roller can be a metal roller provided with a surface layer. As the surface layer on the metal roller, a coating material based on Teflon® or fluorine having a good mold releasing property is effective.

For example, as is shown in FIG. 5, the image forming apparatus of this embodiment has means for switching the bias applied to the brush roller serving as the collecting means from −600 v to +600 v, and by performing this switching operation, the transfer residual toner having the negative polarity on the photoconductor migrates toward the brush. Means for switching the bias voltage applied to the metal roller serving as the cleaning means from −800 v to +800 v at the same time is included in this embodiment, and by performing this switching operation, the transfer residual toner migrates further toward the metal roller and is then removed by the cleaning blade.

A brush roller having the resistance of 1×10e4 to 10e10Ω is usable. When the one having the resistance of 10e4Ω or lower is used, the polarity is reversed due to charge injection or the like for the most of the transfer residual toner taken in by the brush roller before it reaches the contact portion with the metal roller, and consequently, the transfer residual toner may not migrate to the metal roller and instead it may adhere to the photoconductor again. When the one having the resistance of 10e10Ω or higher is used, the efficiency is lowered because the effect is so small unless the applied bias to the brush roller is increased to 1000 v or higher.

The switching of the operation modes in the toner collection portion as described above is performed to meet the purposes, for example, as set forth in the following:

(1) to compensate for the stability of color reproduction over a long term (inversely transferred toner collection mode);

(2) to require a high-quality image in a short term (transfer residual toner collection mode); and (3) to reduce waste toner as much as possible (stirring mode).

In other words, when a high quality is required, or when the transfer efficiency is lowered and the transfer residual toner is apparently to increase (for example, when special paper is used), the toner collection portion is operated in "transfer residual toner collection mode".

Figure 7:
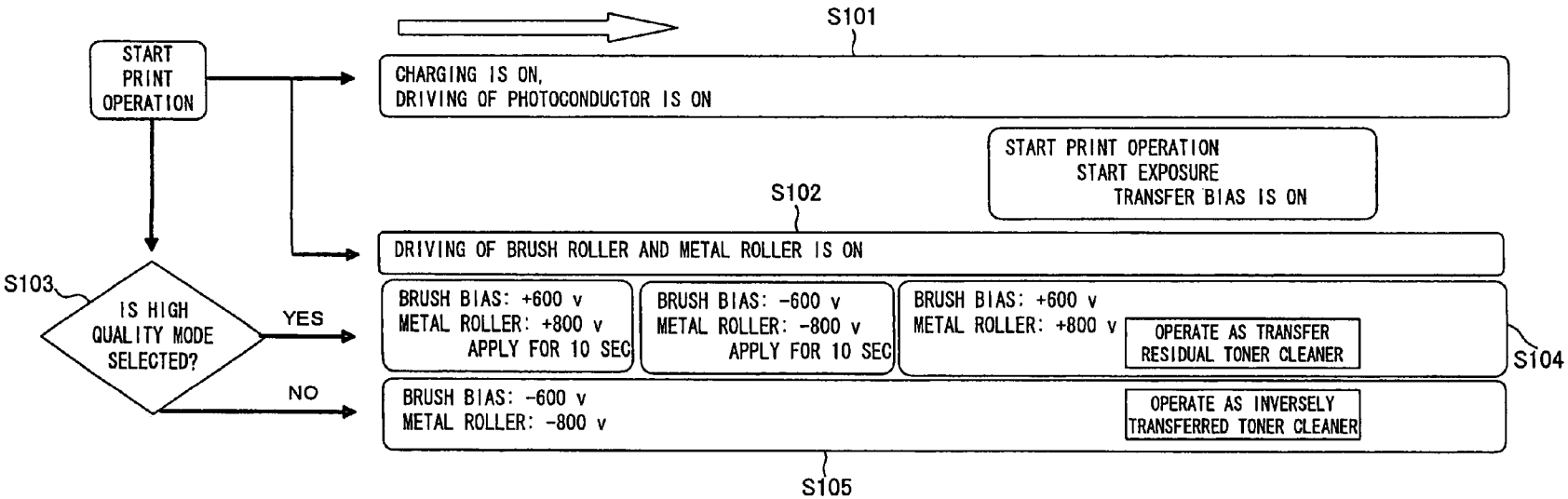
FIG. 7 is a flowchart showing the flow of processing in the image forming apparatus according to the embodiment.

FIG. 7 is a flowchart showing the flow of processing in the image forming apparatus of this embodiment. When a print operation is started, the charging operation and the driving of the photoconductor are started (S101), and the driving and rotating of the brush roller and the metal roller is started (S102). When the user selects the high quality mode on the manipulation input portion 101 (YES in S103), the bias voltage is changed to +600 v for the brush roller and to +800 v for the metal roller, and a preparation operation is performed for 10 sec. During the preparation operation, negatively charged toner adhering onto the brush roller is ejected toward the cleaner and the photoconductor. However, in order to increase the reliability, it is more preferable that another preparation operation is also performed for about 10 sec. with a combination of −600 v as a bias voltage applied to the brush roller and −800 v as a bias voltage applied to the metal roller.

When the operations as described above end, an image is printed under the conditions that the bias voltage applied to the brush roller is +600 v and the bias voltage applied to the metal roller is +800 v, after which the transfer residual toner is collected by the brush and removed by the metal roller and the blade (S104). Because a quantity of inversely transferred toner is so small, a high-quality image can be obtained.

When a high-quality image is not required particularly (NO in S103), a bias voltage of −600 v is applied to the brush and a bias voltage of −800 v is applied to the metal roller normally for the toner collection portion to operate as the inverse transfer cleaner (S105). It is thus possible to maintain satisfactory color reproducibility without the occurrence of color mixing over a long period.

It should be noted that the most of the inversely transferred toner is charged positively, and a quantity thereof is smaller than that of the transfer residual toner. This eliminates the need for a large tank as a so-called waste toner tank to store removed toner. Regarding the inversely transferred toner, although it varies with the toner and the transfer conditions, a quantity of toner present on the photoconductor was measured and found to be 1 to 5 $\mu g/cm^2$ for polymerized toner, and 4 to 10 $\mu g/cm^2$ for normal pulverized toner. Assume that pulverized toner is used, and 7% of each of CMY toners is printed in a state where a quantity of toner present on the photoconductor is 10 $\mu g/cm^2$ and all the CMY toners are inversely transferred in the image forming station for black, then, a collected quantity of inversely transferred toner is about 65 g after printing on 50,000 sheets.

In other words, for a quantity in this order of magnitude, it is not necessary to provide a discharged toner tank separately and carry the toner to the tank, and it is sufficient to provide a place to store the discharged toner near the cleaning blade. For example, by configuring the toner collection portion to be detached from the apparatus as a whole for replacement when the life thereof expires, the mechanism to carry the waste toner can be omitted, which can in turn simplify the overall image forming apparatus. In this embodiment, it is preferable that at least the brush roller serving as the collecting means, the metal roller serving as the cleaning means, the blade pressed against the metal roller, and the waste toner storing portion are formed as one body to be attachable to/detachable from the photoconductor.

In addition, it is preferable that a space to store the inversely transferred toner becomes the largest, for example, in the image forming station on the lowermost stream side, and becomes smaller in the image forming stations on the upper stream side. To describe this using the four-continuous tandem system by way of example, a first image forming station positioned on the uppermost stream side does not need the cleaning mechanism itself because the inversely transferred toner is absent therein. For this reason, in this embodiment, the switching means to the negative bias comprising the brush roller and the metal roller is not provided therein. In a second image forming station, because the inversely transferred toner from the first image forming station alone has to be considered, a quantity is found to be, for example, 65×7/21=22 g from the case described above. In the same manner, a quantity in a third image forming station is found to be 65×14/21=43 g. In other words, by making a capacity of the space to store the inversely transferred toner smaller in the image forming stations on the upstream side than in the image forming stations on the downstream side, it is possible to achieve a size reduction of the entire apparatus.

It should be noted, however, that in the case of the present invention, the toner collection portion also operates as the transfer residual toner cleaner in some situations, and when such operations are performed a large number of times, the size of the waste toner storing portion needs to be larger more than necessary.

Under the current circumstances where the lives of the brush, the metal roller, the blade, etc. are becoming longer, it would be expensive to replace the toner collection portion for every 50,000 sheets. When the replacement cycle is increased to 100,000 sheets, however, the respective waste toner storing portions need twice the capacity at the minimum.

Figure 8:
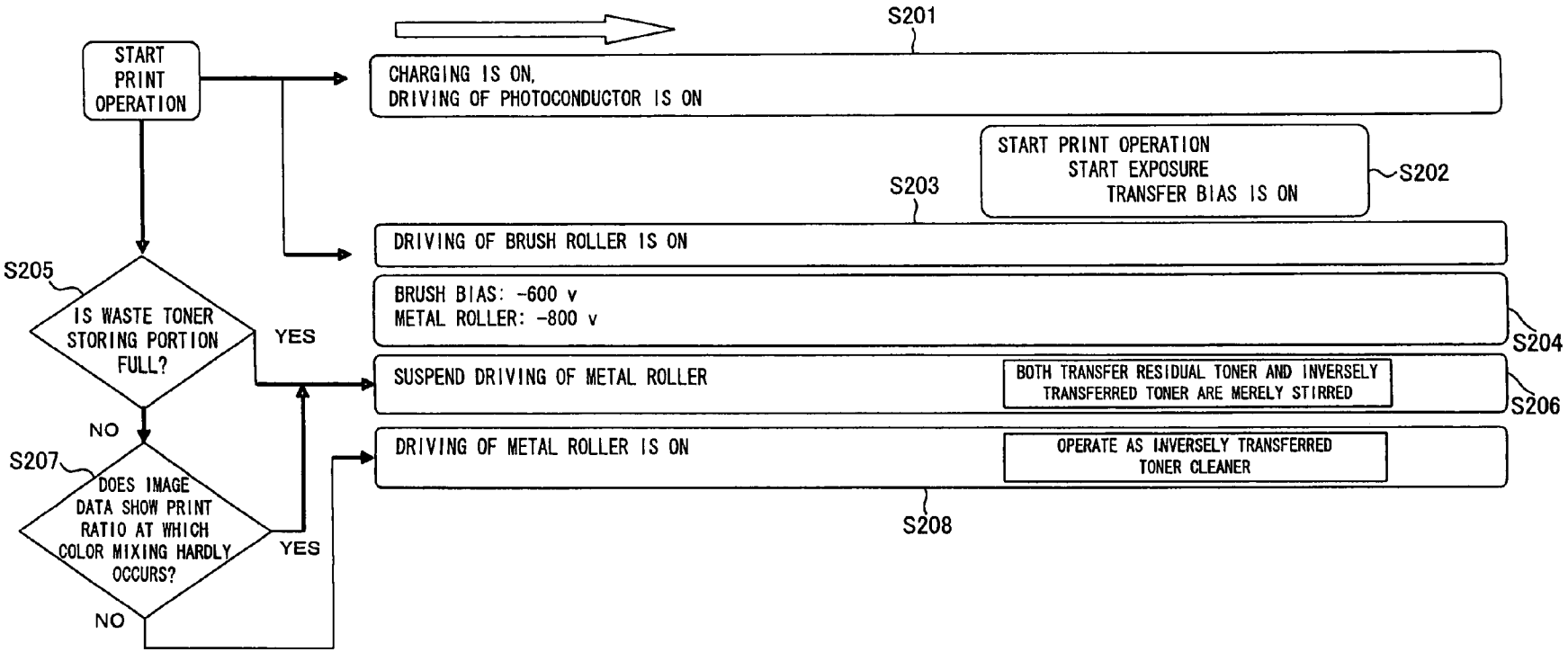
FIG. 8 is a flowchart showing the flow of processing in the image forming apparatus according to the embodiment.

FIG. 8 is a flowchart showing the flow of processing in the image forming apparatus of this embodiment.

When a print operation is started, the charging operation and the driving of the photoconductor are started (S201), and the print operation and the driving and rotating of the brush roller are started (S202 and S203). In this instance, a bias voltage applied to the brush roller is −600 V and a bias voltage applied to the metal roller is −800 V (S204).

In a case where the waste toner storing portion in the toner collection portion is full (YES in S205), or image data of an image formed in the image forming station positioned on the upstream side of the toner collection portion of interest is formed of data with a print ratio at which color mixing (the inversely transferred toner coming into the developer) will not take place (YES in S207), the rotations of the metal roller serving as cleaning means are suspended (S206), and the operation is switched to the operation for stirring alone (stirring mode) by the brush roller. In the stirring mode, a bias voltage of −600 v is applied to the brush roller, and because the metal roller is in contact with the brush roller but it is kept stopped, toner hardly migrates from the brush roller to the metal roller. Under the circumstances where the brush roller is pressed against the photoconductor while −600 v is applied to the brush roller, the brush roller operates as a stirring brush in the normal so-called cleanerless process. Both the transfer residual toner and the inversely transferred toner are therefore stirred and collected in the developer. Whether the inverse transfer readily occurs with the image data of interest is constantly monitored by the CPU 801 as it calculates a ratio of the area in which the inverse transfer occurs on the basis of image data of plural colors.

Meanwhile, in a case where a ratio of the area in which the inverse transfer occurs is equal to or higher than the threshold value (NO in S207), the toner collection portion is operated in the inversely transferred toner collection mode (S208). The effect is larger as the judgment is more accurate. However, when judged merely from a print ratio of each color, it is highly unlikely that the judgment brings the adverse effect. Hence, complicated detection and judgment mechanisms are not necessarily needed.

The toner collection portion is operated in the mode to collect the transfer residual toner as needed only when the user specifically desires a high quality or uses paper having poor transferring property, etc.

It has been described above that in the toner collection portion of this embodiment, at least the brush roller (toner collecting member), the cleaning blade (toner removing member), and the waste toner storing portion (a space provided within the case of the toner collection portion, in which toner removed from the toner collecting member by the toner removing member is accumulated) are formed as one body in the form of a cleaner unit that is attachable to/detachable from the image forming apparatus. In particular, when the life of the photoconductor is long, it is convenient when the toner collection portions Y5 through K5 are set free to be attached to or detached from the photoconductor.

At the time of attachment or detachment, it is important to prevent toner from falling off inside the apparatus from the toner collection portion, and to this end, it is necessary to remove toner adhering onto the brush roller in a satisfactory manner before the cleaner unit is detached from the image forming apparatus after the image print operation ends.

In this embodiment, because the opening in the housing of the toner collection portion is clogged with the brush roller or the elastic roller serving as the toner collecting member, in comparison with a case of the image forming apparatus in the related art having the blade cleaner alone, the fall-off of the toner from the toner collection portion at the time of detachment of the toner collection portion is less likely to occur. Yet, it is possible to prevent the fall-off of toner further by allowing the toner adhering onto the toner collecting member to migrate toward the photoconductor or the waste toner storing portion in a satisfactory manner before the detachment of the toner collection portion.

For example, when the toner collection portion of this embodiment is detached from the image forming apparatus main body, toner on the brush roller is removed in a satisfactory manner by driving and rotating the brush roller for a certain time with a bias voltage being applied while no image printing is performed immediately before the detachment. Alternatively, toner may be removed in a satisfactory manner in a short time by changing bias to be applied to the brush roller or to the metal roller from the one applied for normal image printing.

Figure 9:
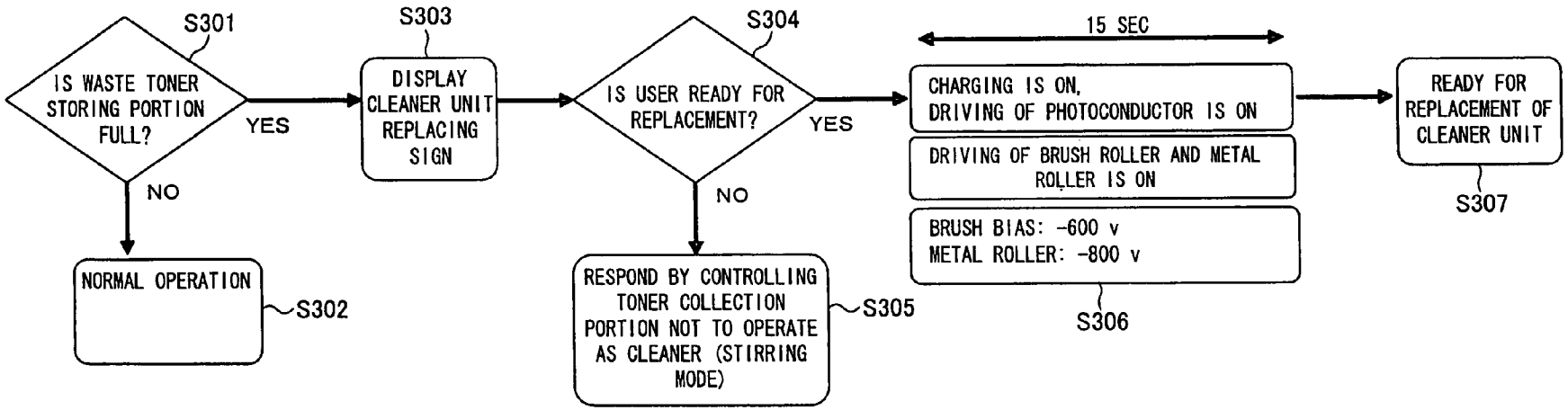
FIG. 9 is a flowchart showing the flow of processing to prevent the fall-off of toner at the time of detachment of a toner collection portion in the image forming apparatus according to the embodiment.

FIG. 9 is a flowchart showing the flow of processing to prevent the fall-off of toner at the time of detachment of the toner collection portion in the image forming apparatus of this embodiment.

When the waste toner quantity detection portion 104 detects that the toner storing portion in any of the toner collection portions is filled with accumulated waste toner (exceeds a specific quantity of toner) (YES in S301), a notice informing that the toner collection portion (cleaner unit) needs replacing is given through an unillustrated display portion or by an unillustrated notice portion (S303).

The CPU 801 suspends the collection operation of the inversely transferred toner and the transfer residual toner in the toner collection portion until the user replaces the toner collection portion with a new one (NO in S304), and stands by while allowing the toner collection portion to operate in the stirring mode (S305). When the user replaces the toner collection portion with a new one (YES in S304), the CPU 801 (corresponds to toner leakage preventing means) automatically drives and rotates the photoconductor, the brush roller, and the metal roller while applying bias voltages of −600 v and −800 v to the brush roller and the metal roller, respectively, for example, over 15 sec. This operation allows positively charged toner adhering onto the brush roller to migrate to the waste toner storing portion in the toner collection portion, while allowing negatively charged toner, which is present in a slightest quantity, to migrate to the photoconductor. It is thus possible to remove toner adhering onto the brush roller.

Also, in order to increase the collection efficiency, it is effective to make a potential difference between the metal roller and the brush roller larger than the one for normal image printing, or to further apply an oscillation electric field, such as AC bias, to the metal roller. For example, by increasing −600 v and −800 v, which are, as shown in FIG. 9, the bias voltage applied to the brush roller and the bias voltage applied to the metal roller, respectively, to about −1000 v, the toner collection efficiency from the brush roller can be enhanced temporarily. In addition, by applying AC bias about DC −800 v+ACpp 1500 v at 500 Hz to the metal roller, the collection efficiency can be enhanced further. In this manner, until the toner collection portion is detached from the photoconductor since the image printing operation ended, the CPU 801 makes the toner collection portion operate for a certain time in a state where no image is being printed, thereby allowing toner accumulated in the toner collection portion to migrate toward the photoconductor or into the toner storing portion. Also, until the toner collection portion is detached from the photoconductor since the image printing operation ended, the CPU 801 controls image printing to be performed without printing an image while changing the surface potential of the photoconductor or the bias applied to the toner collection portion, thereby allowing toner accumulated in the toner collection portion to migrate toward the photoconductor or into the toner storing portion.

In the present invention, the toner collection portion is formed in the form of the cleaner unit that is attachable to/detachable from the image forming apparatus. The user is thus able to perform maintenance of the image forming apparatus almost completely by merely replacing the toner collection portion and the toner tank with new ones provided that the photoconductor, the charger, and the developer need replacing least frequently.

To this end, for example, a photoconductor using α-Si may be used. Also, for a developer using the two-component development using toner and carrier, normally, regular replacement of a developing agent is essentially required, and it is recommended to adopt a method of automatically replacing the carrier little by little without detaching the developer from the image forming apparatus.

Figure 10:
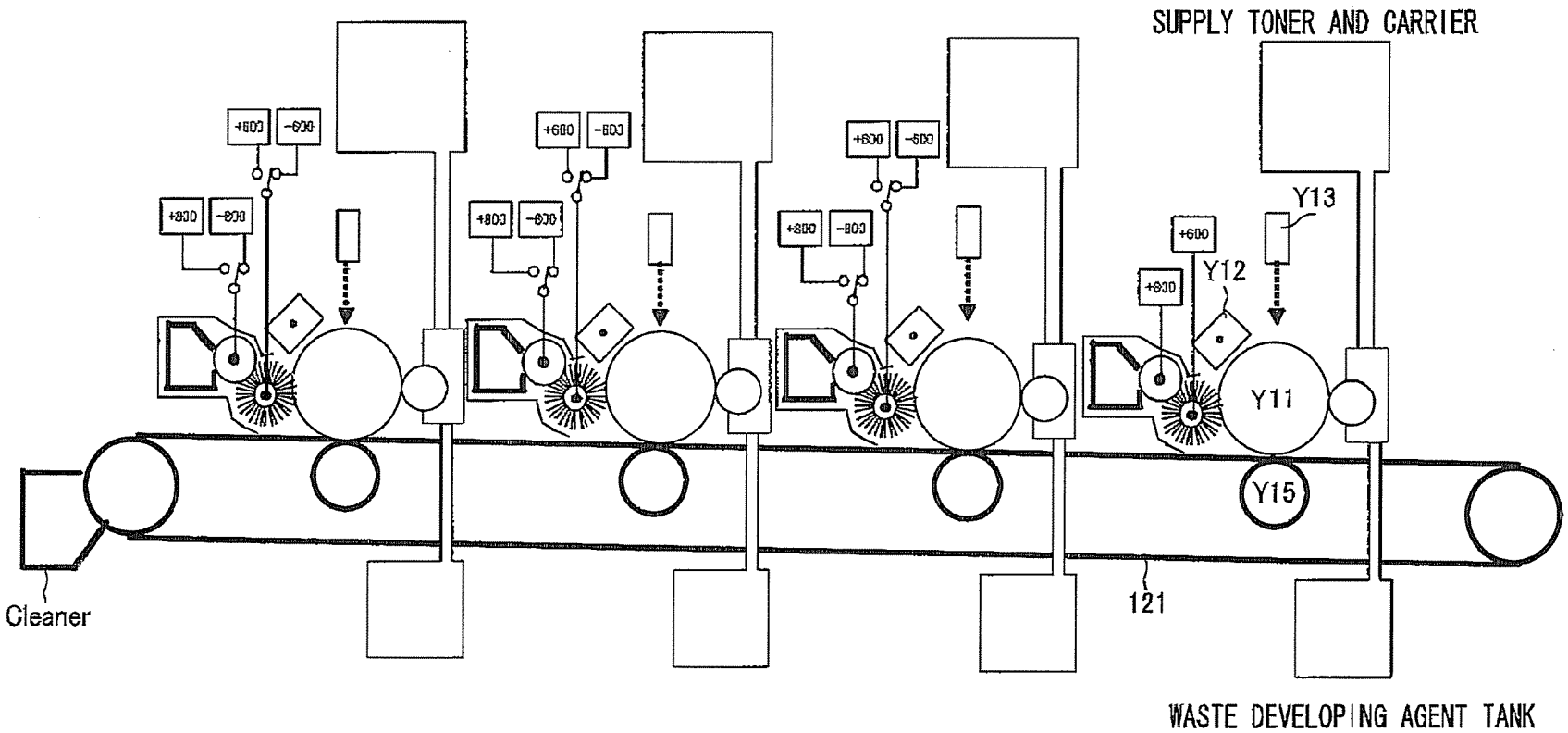
FIG. 10 is a view showing one example of the configuration in the vicinity of the toner collection portion.

In particular, in the case of a color image forming apparatus of the tandem system, the toner collection portion in the image forming station on the upstream side and the developer in the image forming station on the downstream side readily interfere with each other in terms of space. When the developer is reduced in size using a normal developing method, so is a quantity of the developing agent, which shortens the replacement cycle. However, by adopting a small quantity replacing method applicable to a small-size developer and requiring no replacement work of the developing agent, not only is it possible to achieve a more compact, maintenance-free developer, but it is also possible to increase a space for the toner storing portion in the toner collection portion to the extent possible. This configuration provides a synergistic effect that the replacement cycle of the cleaner unit can be extended and the developer does not need replacing. FIG. 10 is a simple view showing the configuration, and this configuration eliminates the need to detach the photoconductor and the developer from the image forming apparatus almost completely. As has been described, by providing developing agent discharging means to the developer and making the developing agent replaceable without attaching/detaching the developer to/from the image forming apparatus main body, it is possible to eliminate the need to attach/detach the developer to/from the image forming apparatus each time the developing agent is replaced with new one.

Figure 11:
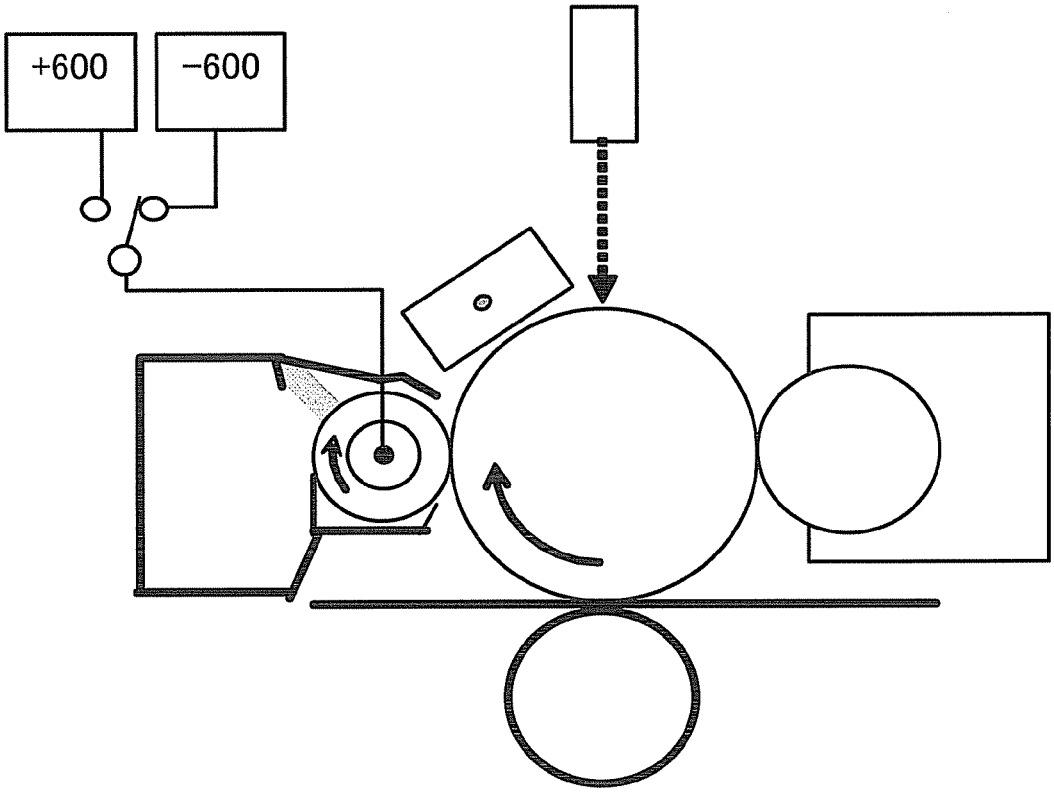
FIG. 11 is a view showing another example of the configuration of a housing near a toner collecting member in the toner collection portion.
Figure 12:
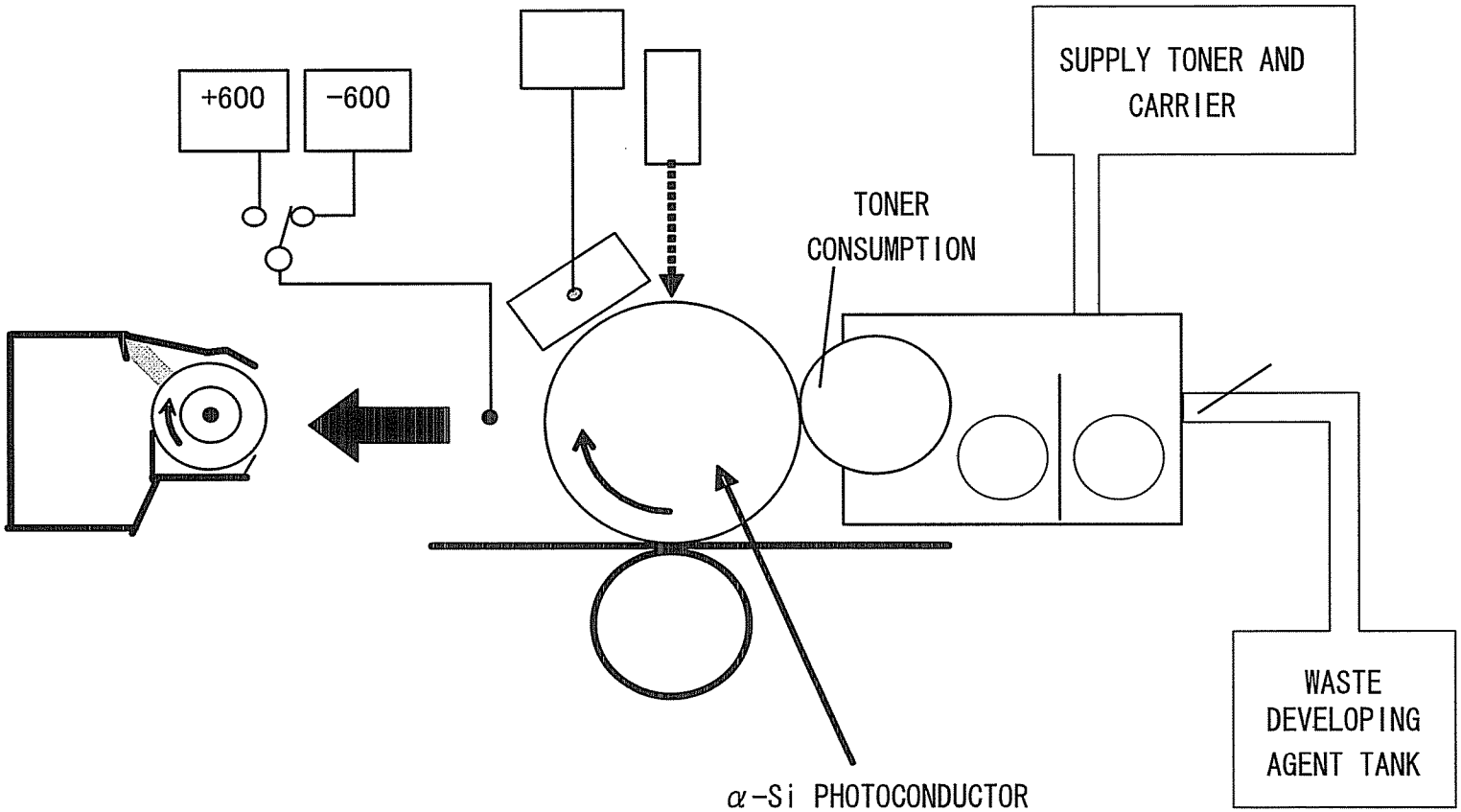
FIG. 12 is a view showing an example of the configuration that makes the toner collection portion alone detachable in the configuration shown in FIG. 11.

FIG. 11 is a view showing another example of the configuration of the housing near the toner collecting member in the toner collection portion. As is shown in the drawing, by forming the toner collecting member to be covered by the housing of the toner collection portion except for the portion that comes into contact with the photoconductor, it is possible to prevent toner adhering onto the toner collecting member from falling off inside the apparatus when the toner collection portion is detached from the image forming apparatus. FIG. 12 is a view showing an example of the configuration in which the toner collection portion alone is formed detachable in the configuration shown in FIG. 11.

Figure 13:
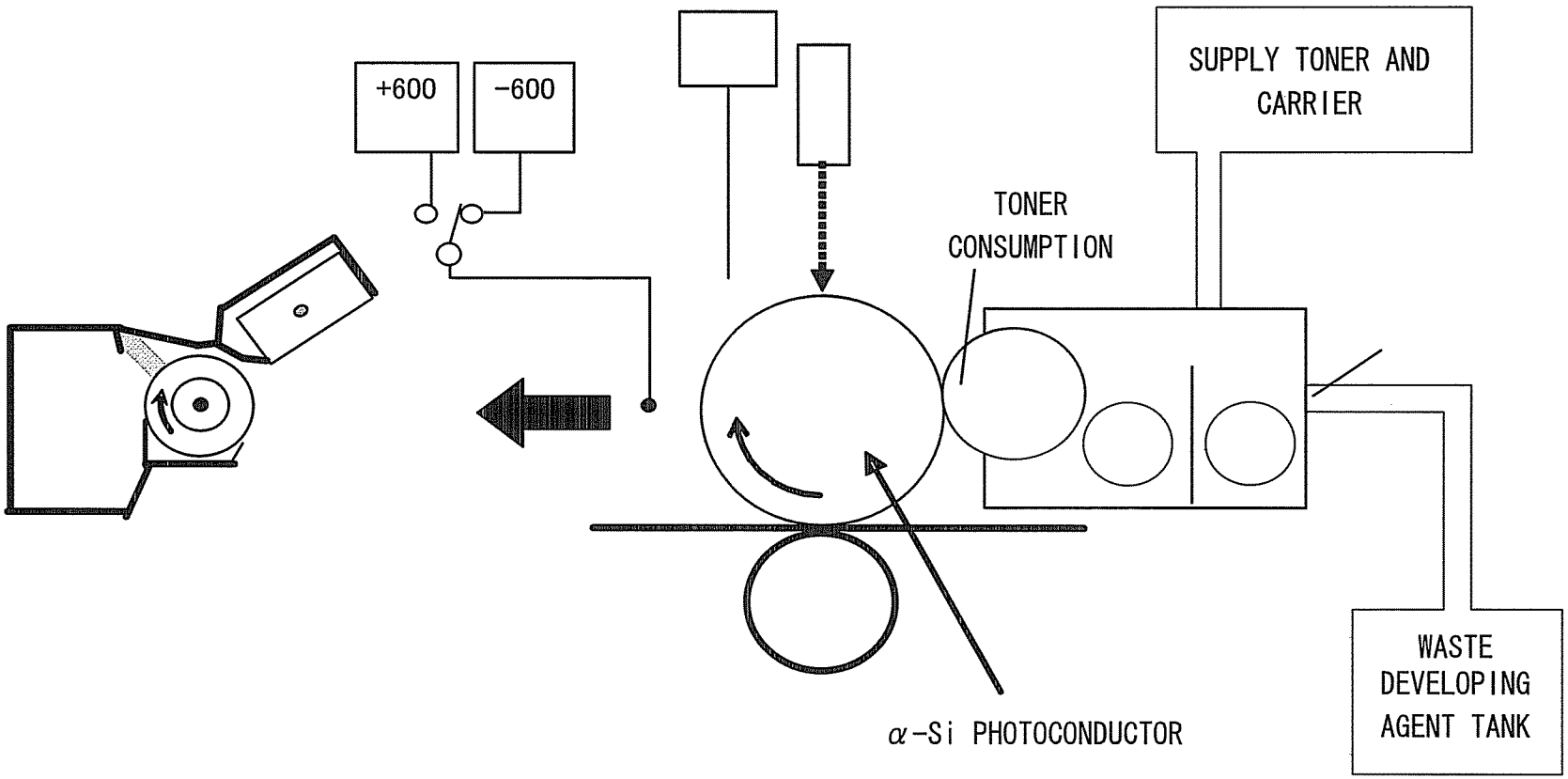
FIG. 13 is a view showing an example of the configuration that makes both the toner collection portion and a charger detachable in the configuration shown in FIG. 11.

FIG. 13 is a view showing an example of the configuration in which both the toner collection portion and the charger are formed detachable in the configuration shown in FIG. 11. According to the configuration shown in the drawing, the toner collection portion and the charger are formed as one body, and the user only has to replace the toner collection portion and the charger that are formed as one body with the toner tank with new ones.

Each of the steps (S101 through S105, S201 through S208, and S301 through S307) in the processing (image forming method) in the image forming apparatus as described above is achieved by causing the CPU 801 to execute the image forming program stored in the memory 802.

This embodiment has described a case where the functions to practice the invention have been previously recorded in the apparatus. The present invention, however, is not limited to this case, and the same functions may be downloaded to the apparatus via a network or a recording medium having stored the same functions may be installed in the apparatus. Any type of recording medium is available as long as it is a recording medium readable by the apparatus and capable of storing a program, such as a CD-ROM. The functions obtained by the pre-installment or downloading may be functions exerted in cooperation with the OS (Operating System) within the apparatus.

Figure 14:
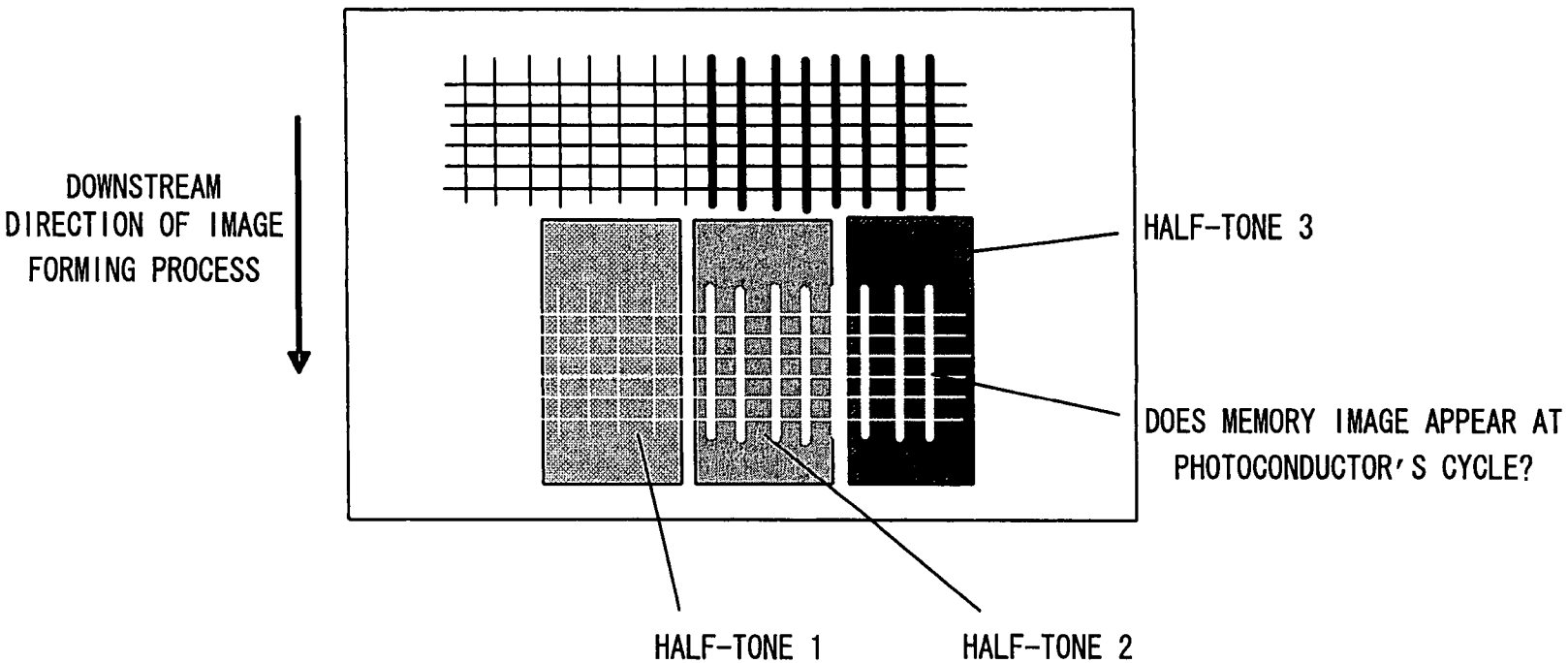
FIG. 14 is a view showing one example of a memory chart.
Figure 15:
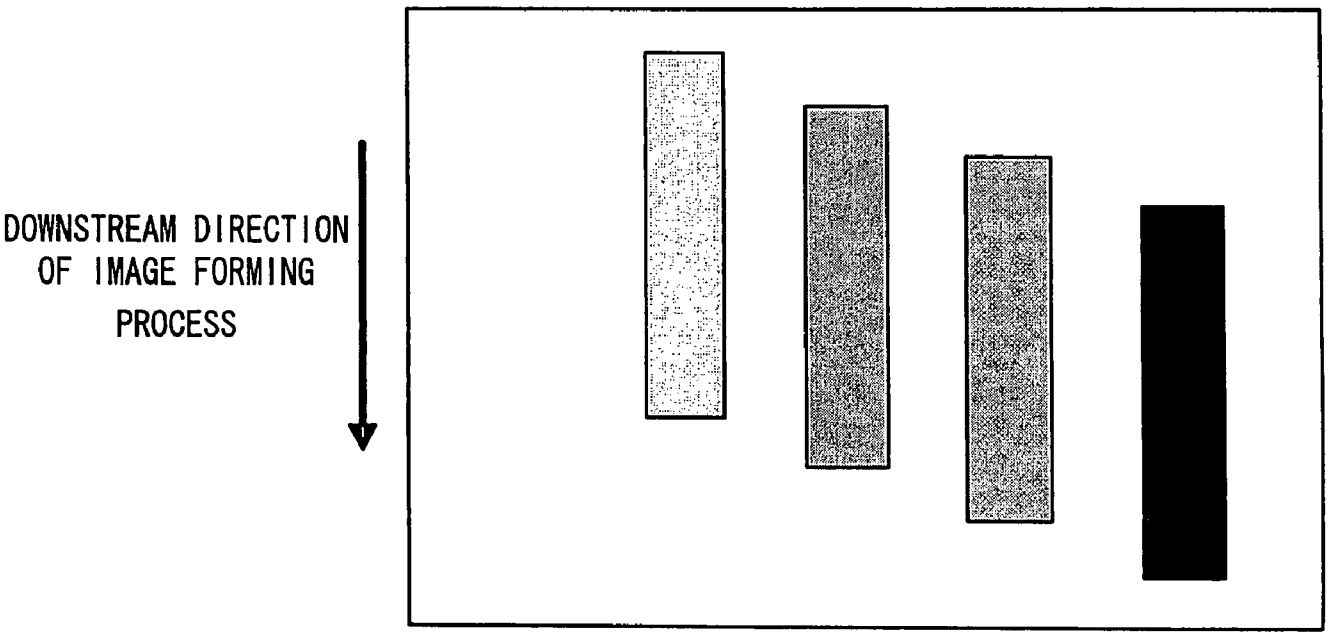
FIG. 15 is a view showing one example of a running chart.

Evaluations of the advantages achieved by the configuration of the image forming apparatus of this embodiment will now be described. Image forming operations were performed continuously to print images as shown in FIG. 14 (one example of a memory chart) and in FIG. 15 (one example of a running chart) by the apparatus configuration (see FIG. 4) in the image forming apparatus in the related art and by the apparatus configuration (see FIG. 5) of this embodiment, and a color mixing level, a quantity of waste toner, and the image quality of a pattern (memory chart) were evaluated.

(Pattern A)

In the first image forming station serving as the yellow station, a patch was printed on a sheet of paper of an A-4 size at the print area ratio of 10%. In the second image forming station serving as the magenta station, a patch was printed at a print area ratio of 10% to avoid overlapping on the yellow image. No printing was performed in the third image forming station serving as the cyan station and in the Bk station.

(Pattern B)

In the first image forming station serving as the yellow station, a patch was printed on a sheet of paper of A-4 size at the print area ratio of 10%. In the second image forming station serving as the magenta station, a patch was printed at a print area ratio of 10% to avoid overlapping on the yellow image. Further, in the third image forming station serving as the cyan station, printing was performed at an area ratio of 10% to avoid overlapping on the yellow and magenta images, and printing was performed at 10% in the same manner in the Bk station, too (see FIG. 15).

(Pattern C)

In the first image forming station serving as the yellow station, a patch was printed on a sheet of paper of A-4 size at the print area ratio of 2%. In the second image forming station serving as the magenta station, a patch was printed at a print area ratio of 2% to avoid overlapping on the yellow image. Further, in the third image forming station serving as the cyan station, printing was performed at an area ratio of 12% to avoid overlapping on the yellow and magenta images, and printing was performed at 12% in the same manner in the Bk station, too.

(Pattern D (Memory Chart))

A memory chart was printed in each color in such a manner that the transfer residual toner corresponds to a half-tone portion when an image is formed by a next rotation of the photoconductor (a total of print ratios of respective colors is 40%) (see FIG. 14).

These four patterns were printed on normal sheets of paper (for use of color copying machine: 80 g/sheet) and thick sheets of paper (250 g).

The apparatus configurations used to print these four patterns were four kinds as follows: the apparatus configuration in the related art; (1) the configuration of the present invention in a state where the toner collection portion is operated as the inversely transferred toner cleaner; (2) the configuration of the present invention in a state where the toner collection portion is operated as the transfer residual toner cleaner; and (3) the configuration of the present invention in a state where the toner collection portion collects neither the transfer residual toner nor the inversely transferred toner. It should be noted that the apparatus configuration in the related art and the apparatus configuration in (3) are almost the same.

Regarding the number of printed sheets, after the pattern A was printed on 5,000 normal sheets of paper, the patterns B and C were printed successively in the same manner, and the pattern D was printed in the last on a total of 1,000 sheets of paper: 800 normal sheets of paper and 200 thick sheets of paper. A total of 16,000 sheets of paper were printed by a series of these print operations, and the results, such as the color mixing level and a quantity of waste toner in the cyan station, in a state when each image had been printed are set forth in FIG. 16.

Initially, the image of the pattern A was printed on 5,000 sheets of paper by the apparatus configuration in the related art, and a color difference, ΔE, before and after the continuous printing in the cyan station was checked and found to be ΔE=15. This is no good because an allowable variance of the color difference on an image is generally said to be less than 6. When the patterns B and C were printed continuously on 5,000 sheets of paper for each, because cyan toner was consumed and replenished, the color difference was improved to about ΔE=3. Subsequently, when the memory chart of the pattern 4 was printed, the memory image appeared slightly in the half-tone portion, and the result was no good for thick sheets of paper because the memory image appeared noticeably. In the case of the apparatus configuration in the related art, because the waste toner storing portion was not provided, a quantity of waste toner was nearly 0.

In the case of operations in "inversely transferred toner collection mode" specified in (1), when the pattern A was printed on 5,000 sheets of paper, the color difference was about ΔE=4, which falls within an allowable range. A quantity of waste toner stored in the waste toner storing portion in this stance was 6.2 g. Subsequently, when the patterns B and C were printed on 5,000 sheets of paper for each, because cyan toner was consumed and replenished for the patterns B and C, the color difference was reduced further, and restored to a variance of 0. When the pattern D was printed after a total of 15,000 sheets of paper had been printed, the memory image appeared slightly in the half-tone portion and it appeared more noticeably on thick sheets of paper. A quantity of waste toner in the cyan station when 16,000 sheets of paper had been printed was 14.6 g.

Then, the same experiment was conducted in "transfer residual toner collection mode" in (2). When the pattern A was printed on 5,000 sheets of paper, the result was no good because the variance of color difference reached about ΔE=13. Because cyan toner was consumed and replenished for the patterns B and C, the color difference was improved and reached about ΔE=2 when 15,000 sheets of paper had been printed. When the pattern D was printed subsequently, no memory image or the like appeared regardless of the kinds of sheets of paper. A final quantity of waste toner was about 27 g.

In the mode to collect neither the transfer residual toner nor the inversely transferred toner (stirring mode) in (3), the result was similar to that of the apparatus configuration in the related art. A variance of color difference was too large with the pattern A, and the memory image appeared noticeably in the memory chart particularly on thick sheets of paper.

In view of the foregoing, for an image consuming a less quantity of cyan toner as the pattern A, by controlling the toner collection portion to operate in the inversely transfer toner collection mode in (1) as in this embodiment, the color difference was found to be ΔE=3.9 when the pattern A had been printed on 5,000 sheets of paper, and for a case where cyan toner was consumed and mixing of a slight quantity of mixed color toner was allowable as the patterns B and C, a quantity of waste toner was reduced by controlling the toner collection portion to operate in the stirring mode in (3). In the experiments, when the toner collection portion was operated in the inversely transferred toner collection mode in (1) for all the patterns A, B, and C, a quantity of waste toner when 15,000 sheets of paper had been printed was 14.3 g. It was discovered, however, that when the toner collection portion was operated in the stirring mode in (3) for the patterns B and C as in this embodiment, it was possible to reduce the quantity to 6.6 g. By applying the transfer residual toner collection mode in (2) when a half-tone image, in which the memory image readily appears, was printed subsequently, this embodiment succeeded in forestalling the occurrence of an inconvenience on the image even on a thick sheet of paper with which the transfer efficiency is lowered. The final quantity of waste toner was 13.5 g, which is far smaller than that in a case where the operation mode was not changed at all; moreover, the variance of color difference falls within the allowable range and a high-quality image was obtained even when thick sheets of paper were used for the memory chart or the like.

A quantity of waste toner varies considerably with a transfer efficiency and an inverse transfer efficiency. Generally, toner close to a spherical shape has a good transfer efficiency. Also, polymerized toner having uniform charged quantity distribution and particle size achieves stable transferring, and it is advantageous when applied to the configuration of this embodiment.

As has been described, in addition to the mode in which the cleaner portion operates as the inverse transfer cleaner during printing in the apparatus configuration in the related art, the embodiment of the present invention is configured to additionally provide the transfer residual toner collection mode to chiefly clean the toner of the original, normal color during a series of print operations.

By controlling the toner collection portion to operate in the transfer residual toner collection mode, the toner of the normal color is chiefly cleaned, and meanwhile the inversely transferred toner is stirred instead of being collected. The stirred inversely transferred toner is then reversely charged to the normal polarity in the charging portion and collected in the developer by passing by the exposure portion. This configuration therefore also achieves the so-called cleanerless process. Because a quantity of the inversely transferred toner is extremely small in comparison with a quantity of the transfer residual toner of the normal color, the level of deteriorating the image quality in the cleanerless process is improved by far by cleaning the toner of the normal color than by cleaning the inversely transferred toner.

In this embodiment, for example, in the high quality mode for a case where the user requires a high quality, the cleaner portion is operated as the cleaner for toner of the normal color to prevent the appearance of the image memory. For the inversely transferred toner in a slight quantity, the cleanerless process is achieved by stirring the inversely transferred toner. In a case of data having a high print ratio in the image forming station on the upstream side and a low print ratio in the image forming station of interest, that is, the data with which a large quantity of so-called mixed color toner is likely to be produced, the cleaner portion is allowed to automatically operate as the inverse transfer cleaner to prevent the inversely transferred toner from coming into the developer. At the same time, the toner of the normal color is stirred to achieve the second cleanerless process.

Operations as above enables a high-quality image to be obtained when a high quality is required; moreover, these operations enable the inversely transferred toner to be collected automatically in the cleaner portion for an image that readily gives rise to color mixing. It is thus possible to provide a cleanerless image forming apparatus achieving a high quality and hardly causing color mixing.

Also, in addition to the inversely transferred toner collection mode in which the toner collection portion operates as the inverse transfer cleaner during printing in the apparatus configuration in the related art, this embodiment additionally provides the stirring mode in which the toner collection portion removes neither the inversely transferred toner nor the transfer residual toner, that is, the toner collection portion operates as a normal so-called cleanerless process. In the stirring mode, although the inversely transferred toner comes into the developer, no problem occurs for an image to be printed. In particular, even when a small quantity of toner of a different color comes inside from the image forming station on the upstream side, in a case where toner of its own color is consumed in a satisfactory manner, the toner of a different color is consumed as well, and no color mixing takes place. In such a case, there is no need to collect or remove the inversely transferred toner selectively. Because a quantity of waste toner is not increased unless it is collected, a space for storing waste toner can be smaller. In addition, by controlling the toner collection portion to operate while indicating a replacement sign to the user when the waste toner storing portion has become full or the like, it is possible to eliminate the need to suspend the apparatus even when the waste toner storing portion becomes full.

The embodiment above has described a case where the brush roller is adopted as the means (toner collection portion) for collecting toner adhering onto the photoconductive surface of the photoconductor. The invention, however, is not limited to this case. For example, an elastic roller made of rubber or the like can be adopted as well.

The embodiment above has described the configuration of the so-called "direct transfer method" by which a toner image is directly transferred onto a sheet of paper from the image forming station by way of example. The invention, however, is not limited to this example, and it goes without saying that the same advantages can be achieved with a method by which toner images are formed temporarily on an intermediate transfer body (in this case, the intermediate transfer body is the transferred body) to superpose images of plural colors one another, and then the secondary transfer process is performed to transfer the superposed images on a sheet of paper.

While the present invention has been described in detail in particular embodiments, it is obvious that various modifications and alternations occur to those skilled in the art without deviating from the sprit and the scope of the invention.

As has been described above in detail, the invention can provide a technique for achieving appropriate toner collection from the photoconductive surface of the photoconductor to suit the situations in an image forming apparatus that forms a toner image on a sheet of paper.

What is claimed is:

1. An image forming apparatus that performs image forming processing using plural image forming stations aligned along a specific direction and each transferring a toner image of a different color onto a transferred body moving in the specific direction, comprising:

a toner collection unit provided to at least one image forming station among the plural image forming stations at any of second and subsequent places from an upstream side in the specific direction and configured to collect toner adhering onto a photoconductor in the at least one image forming station near a toner image transfer position of the photoconductor on a downstream side, the toner collection unit being capable of switching between an inversely transferred toner collection mode to selectively collect inversely transferred toner having a charged polarity different from a polarity of toner used in the image forming station to which the toner collection unit is provided and a transfer residual toner collection mode to selectively collect transfer residual toner having a charged polarity same as the polarity of the toner used in the image forming station to which the toner collection unit is provided;

a judgment unit configured to judge which of the transfer residual toner and the inversely transfer toner needs to be collected according to specific information; and a control unit configured to control the toner collection unit to execute the transfer residual toner collection mode when the judgment unit judges that the transfer residual toner needs to be collected, and to control the toner collection unit to execute the inversely transferred toner collection mode when the judgment unit judges that the inversely transferred toner needs to be collected.

2. The image forming apparatus according to claim 1, wherein:

the judgment unit judges that the inversely transferred toner needs to be collected by an arbitrary toner collection unit when image data of an image to be formed on the transferred body shows that a print ratio in an image forming station positioned on an upstream side in the specific direction from an image forming station to which the arbitrary toner collection unit is provided exceeds a specific print ratio.

3. The image forming apparatus according to claim 1, further comprising:

a manipulation input unit configured to accept a manipulation input from a user, wherein the judgment unit judges that the transfer residual toner needs to be collected when a manipulation input to select a high quality mode is accepted at the manipulation input unit.

4. The image forming apparatus according to claim 1, further comprising:

an environment detection unit configured to detect a temperature and a humidity, wherein the judgment unit judges that the transfer residual toner needs to be collected when the temperature and the humidity detected in the environment detection unit fit to a specific high temperature and high humidity condition.

5. The image forming apparatus according to claim 1, wherein:

the toner collection unit includes a toner collecting member to which a specific bias voltage is applied.

6. The image forming apparatus according to claim 5, wherein:

the control unit controls the toner collection unit to execute switching between the inversely transferred toner collection mode and the transfer residual toner collection mode by switching polarities of the bias voltage applied to the toner collecting member.

7. An image forming apparatus that performs image forming processing using plural image forming stations aligned along a specific direction and each transferring a toner image of a different color onto a transferred body moving in the specific direction, comprising:

a toner collection unit provided to at least one image forming station among the plural image forming stations at any of second and subsequent places from an upstream side in the specific direction and configured to collect toner adhering onto a photoconductor in the at least one image forming station near a toner image transfer position of the photoconductor on a downstream side, the toner collection unit being capable of switching between an inversely transferred toner collection mode to selectively collect inversely transferred toner having a charged polarity different from a polarity of toner used in the image forming station to which the toner collection unit is provided and a stirring mode to stir toner on the photoconductor in the image forming station to which the toner collection unit is provided;

a judgment unit configured to judge which of operations to collect the inversely transferred toner and to stir the toner on the photoconductor needs to be performed according to specific information; and a control unit configured to control the toner collection unit to execute the inversely transferred toner collection mode when the judgment unit judges that the inversely transferred toner needs to be collected, and to control the toner collection unit to execute the stirring mode when the judgment unit judges that the toner on the photoconductor needs to be stirred, wherein:

the judgment unit judges that the inversely transferred toner needs to be collected by an arbitrary toner collection unit when image data of an image to be formed on the transferred body shows that a print ratio in an image forming station positioned on an upstream side in the specific direction from an image forming station in which the arbitrary toner collection unit is provided exceeds a specific print ratio.

8. An image forming apparatus that performs image forming processing using plural image forming stations aligned along a specific direction and each transferring a toner image of a different color onto a transferred body moving in the specific direction, comprising:

a toner collection unit provided to at least one image forming station among the plural image forming stations at any of second and subsequent places from an upstream side in the specific direction and configured to collect toner adhering onto a photoconductor in the at least one image forming station near a toner image transfer position of the photoconductor on a downstream side, the toner collection unit being capable of switching between an inversely transferred toner collection mode to selectively collect inversely transferred toner having a charged polarity different from a polarity of toner used in the image forming station to which the toner collection unit is provided and a stirring mode to stir toner on the photoconductor in the image forming station to which the toner collection unit is provided;

a judgment unit configured to judge which of operations to collect the inversely transferred toner and to stir the toner on the photoconductor needs to be performed according to specific information; and a control unit configured to control the toner collection unit to execute the inversely transferred toner collection mode when the judgment unit judges that the inversely transferred toner needs to be collected, and to control the toner collection unit to execute the stirring mode when the judgment unit judges that the toner on the photoconductor needs to be stirred, further comprising:

a waste toner quantity estimation unit configured to estimate a quantity of toner accumulated in the toner collection unit, wherein the judgment unit judges that the toner on the photoconductor needs to be stirred in a case where the quantity of toner estimated in the waste toner quantity estimation unit exceeds a specific quantity.

9. The image forming apparatus according to claim 8, further comprising:

a waste toner quantity detection unit configured to detect the quantity of toner accumulated in the toner collection unit, wherein the waste toner quantity estimation unit estimates the quantity of toner accumulated in the toner collection unit according to the quantity of toner detected in the waste toner quantity detection unit.

10. The image forming apparatus according to claim 8, further comprising:

a history information acquisition unit configured to acquire information about a history of image forming processing in the image forming apparatus, wherein the waste toner quantity estimation unit estimates the quantity of toner accumulated in the toner collection unit according to the information acquired in the history information acquisition unit.

11. An image forming apparatus that performs image forming processing using an image forming station that transfers a toner image onto a transferred body moving in a specific direction, comprising:

a toner collection unit provided to the image forming station and configured to collect toner adhering onto a photoconductor in the image forming station near a toner image transfer position of the photoconductor on a downstream side, the toner collection unit being capable of switching between a transfer residual toner collection mode to selectively collect transfer residual toner having a charged polarity same as a polarity of toner used in the image forming station to which the toner collection unit is provided and a stirring mode to stir toner on the photoconductor in the image forming station to which the toner collection unit is provided;

a judgment unit configured to judge which of operations to collect the transfer residual toner and to stir the toner on the photoconductor needs to be performed according to specific information; and a control unit configured to control the toner collection unit to execute the transfer residual toner collection mode when the judgment unit judges that the transfer residual toner needs to be collected, and to control the toner collection unit to execute the stirring mode when the judgment unit judges that the toner on the photoconductor needs to be stirred.

12. The image forming apparatus according to claim 11, wherein:

the judgment unit judges that the transfer residual toner needs to be collected by the toner collection unit when image data of an image to be formed on the transferred body shows that a print ratio in the image forming station exceeds a specific print ratio.

13. The image forming apparatus according to claim 11, further comprising:

a manipulation input unit configured to accept a manipulation input from a user, wherein the judgment unit judges that the transfer residual toner needs to be collected when a manipulation input to select a high quality mode is accepted at the manipulation input unit.

14. The image forming apparatus according to claim 11, further comprising:

an environment detection unit configured to detect a temperature and a humidity, wherein the judgment unit judges that the transfer residual toner needs to be collected when the temperature and the humidity detected in the environment detection unit fit to a specific high temperature and high humidity condition.

15. The image forming apparatus according to claim 11, further comprising:

a waste toner quantity estimation unit configured to estimate a quantity of toner accumulated in the toner collection unit, wherein the judgment unit judges that the toner on the photoconductor needs to be stirred in a case where the quantity of toner estimated in the waste toner quantity estimation unit exceeds a specific quantity.

16. The image forming apparatus according to claim 15, further comprising:

a waste toner quantity detection unit configured to detect the quantity of toner accumulated in the toner collection unit, wherein the waste toner quantity estimation unit estimates the quantity of toner accumulated in the toner collection unit according to the quantity of toner detected in the waste toner quantity detection unit.

17. The image forming apparatus according to claim 15, further comprising:

a history information acquisition unit configured to acquire information about a history of image forming processing in the image forming apparatus, wherein the waste toner quantity estimation unit estimates the quantity of toner accumulated in the toner collection unit according to the information acquired in the history information acquisition unit.

18. The image forming apparatus according to claim 11, wherein:

the toner collection unit includes a toner collecting member to which a specific bias voltage is applied.

* * * * *